US007091166B2

(12) United States Patent
Held, III

(10) Patent No.: US 7,091,166 B2
(45) Date of Patent: Aug. 15, 2006

(54) ACIDIC, PHOSPHATE-FREE PLASTIC CLEANER COMPOSITION WITH REDUCED MILD STEEL EQUIPMENT ETCH FOR CLEANING PLASTIC PARTS

(75) Inventor: Theodore D. Held, III, Grosse Pointe Farms, MI (US)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 366 days.

(21) Appl. No.: 10/102,254

(22) Filed: Mar. 20, 2002

(65) Prior Publication Data

US 2003/0041885 A1 Mar. 6, 2003

Related U.S. Application Data

(60) Provisional application No. 60/277,388, filed on Mar. 20, 2001.

(51) Int. Cl.
*C11D 1/94* (2006.01)
*C11D 7/08* (2006.01)

(52) U.S. Cl. ..... 510/243; 510/220; 510/223; 510/225; 510/229; 510/237; 510/269; 510/421; 510/422; 510/434; 510/477; 510/490

(58) Field of Classification Search ..... 510/243, 510/220, 223, 225, 229, 237, 269, 421, 422, 510/434, 477, 490
See application file for complete search history.

(56) References Cited

U.S. PATENT DOCUMENTS 4,001,394 A * 1/1977 Fogel et al. ..... 510/123
4,062,976 A * 12/1977 Michaels ..... 514/561
4,075,350 A * 2/1978 Michaels ..... 514/556
4,526,781 A * 7/1985 Goldberg et al. ..... 424/70.21
4,741,855 A * 5/1988 Grote et al. ..... 510/122
4,992,266 A * 2/1991 Knoll ..... 424/70.11
5,073,368 A * 12/1991 Subramanian ..... 424/58
5,217,652 A * 6/1993 Iovanni ..... 510/121
5,275,804 A * 1/1994 Michaels ..... 424/54
5,294,364 A 3/1994 Thomas et al.
5,384,063 A * 1/1995 Woo et al. ..... 510/422
5,389,283 A * 2/1995 Held, III ..... 510/244
5,399,280 A * 3/1995 Woo et al. ..... 510/424
5,556,616 A * 9/1996 Janchitraponvej et al. ..... 424/70.122
5,583,265 A * 12/1996 Woo et al. ..... 604/391
5,607,913 A * 3/1997 Woo et al. ..... 510/413
5,612,308 A * 3/1997 Woo et al. ..... 510/423
5,639,722 A 6/1997 Kong et al.
5,672,578 A 9/1997 Carrie et al.
5,807,816 A * 9/1998 Cottrell et al. ..... 510/235
6,184,190 B1 * 2/2001 D'Ambrogio et al. ..... 510/130
6,242,411 B1 * 6/2001 D'Ambrogio et al. ..... 510/425
6,303,556 B1 * 10/2001 Kott et al. ..... 510/357

* cited by examiner

*Primary Examiner*—Charles Boyer
(74) *Attorney, Agent, or Firm*—Stephen D. Harper; Mary K. Cameron

(57) ABSTRACT

An aqueous liquid composition comprising water; at least one acid selected from the group consisting of carboxylic acids, hydroxycarboxylic acids, and inorganic acids other than phosphoric acid wherein the at least one acid is present in an amount from about 1.0 to about 30 milliequivalents per kilogram of total composition ("mEq/kg"); and an amphoteric surfactant wherein the amphoteric surfactant is present in an amount from about 0.01 to about 20 grams per kilogram of total composition ("g/kg"), the aqueous liquid composition having a pH from about 2.0 to about 6.1 and having a reduced etch attack on metal as compared to an aqueous composition comprising from about 1.0 to about 30 milliequivalents per kilogram of total composition ("mEq/kg") of acids selected from the group consisting of carboxylic, hydroxycarboxylic, and inorganic acids, and not containing the amphoteric surfactant.

13 Claims, 1 Drawing Sheet

ACIDIC, PHOSPHATE-FREE PLASTIC CLEANER COMPOSITION WITH REDUCED MILD STEEL EQUIPMENT ETCH FOR CLEANING PLASTIC PARTS

CROSS-REFERENCE TO RELATED APPLICATIONS

This application claims the benefit of U.S. provisional application Ser. No. 60/277,388 filed Mar. 20, 2001.

BACKGROUND OF THE INVENTION

1. Field of the Invention

The present invention relates generally to compositions and processes for cleaning engineering plastic surfaces, and, more particularly, to such compositions that are substantially or entirely free from phosphate and have a reduced mild steel equipment etch.

2. Background Art

Numerous compositions and processes for cleaning plastic surfaces are currently known in the art. Most of them include acid, surfactant(s), and phosphates. In some locations, however, phosphates are forbidden or severely limited to avoid potential pollution and eutrophication of bodies of water that receive discharges of industrial waste water. Thus, compositions that contain little or no phosphate but are still effective cleaners have been sought.

Among the known cleaning compositions containing phosphates, there is a composition that contains phosphoric acid, citric acid, and esters of phosphoric acid together with alkylaminopolyglycol ether surfactant and sufficient basic constituents to result in a pH of about 2. There is also a phosphate-containing cleaner for removing mold that comprises peroxides, phosphoric acid or phosphate salts, divalent cations, and lower carboxylic acids or salts thereof. Citric acid and citrates may constitute the latter ingredient. An aqueous emulsifier composition containing phosphates for cleaning metal surfaces is also known. The emulsifier composition contains oxyethylated alcohol; mono-, di-, or triethylamino carbonate; disodium mono-, di-, or triethylamino ethylenediaminetetraacetate or sodium tripolyphosphate; sodium citrate; and water. Finally, there is a composition containing citric acid, a phosphate salt, a wetting agent, and a corrosion inhibitor that is useful for cleaning metal or plastic surfaces from corrosive etching solutions or their reaction products.

Among the known plastic cleaning solutions is a cleaner for fiber reinforced plastic moldings which is improved by adding to the "usual" ingredients, such as surfactant(s) and organic solvent(s), a carboxylic and/or hydroxycarboxylic acid, which may be citric acid. A known spray cleaning composition for plastic articles includes water insoluble inorganic powder and conventional surfactants and may also contain builders, defoaming agents, chelating agent, and solvent. Citric acid is taught as an example of a chelating agent. A detergent composition recommended for cleaning plastic sheets used in horticulture contains polyoxyethylene alkyl ether (a nonionic surfactant) and sodium citrate as its main components. Another composition for cleaning metal, plastic, or glass includes lithium salts of an acidic partial ester of sulfuric acid, of a sulfonic acid, or of an alkanolamine with citric acid as an optional ingredient.

Compositions containing a weak organic acid and an acrylic polymer have been used to clean semipermeable membranes, such as cellulose acetate and triacetate, polyamide, and polysulfone membranes. Preferred weak acids for this membrane cleaning application include citric acid, malic acid, sulfamic acid, and mixtures thereof. Another known acid-containing composition is used for cleaning ceramic cladding materials. This composition includes citric acid and partially hydrogenated caprolactam oligomers.

Finally, liquid detergent compositions containing surfactants are known. The surfactant acts function to retard redeposition of soil. Furthermore, these detergent compositions may include a water soluble sequestrant builder that may be or include citrates.

SUMMARY OF THE INVENTION

This invention relates to compositions and processes for cleaning engineering plastic surfaces. Surfaces that can be effectively cleaned according to this invention include, but are not limited to, polyester sheet molding compound ("SMC"); polyvinyl chloride ("PVC ") homopolymers and copolymers; polyurethane and polyurea plastics such as those made commercially by injection molding; terpolymers of acrylonitrile, butadiene, and styrene ("ABS"); poly{phenylene oxide} ("PPO") and copolymers of "phenylene oxide" with other materials such as polyamides; polycarbonate ("PCO") polymers and copolymers; and thermoplastic polyolefins ("TPO"). The invention is particularly suited to cleaning plastics, more particularly SMC, that contain solid filler materials, especially those that are chemically alkaline, such as calcium carbonate.

The compositions of the invention are substantially or entirely free from phosphate and can be substantially or entirely free from volatile organic solvents as well, and are therefore less polluting than the now common commercial acidic cleaners for plastics. Plastic surfaces are typically cleaned by equipment that has metal components. A further advantage of the compositions of the present invention is a lowered etching of metal components, and in particular components made from cold rolled steel. Such components may include tanks or other containment structure; plumbing, including pumps; and racking and conveyor equipment used for transport of the plastic articles.

One embodiment of a composition according to this invention, specifically a composition suited for direct use as such in cleaning plastic surfaces, is an acidic aqueous liquid solution that comprises, preferably consists essentially of, or more preferably consists of, water and:

(A) carboxylic and/or hydroxycarboxylic acid or acids and/or an inorganic acid or acids other than phosphoric acid; and (B) an amphoteric surfactant;

and, optionally, one or more of the following:

(C) salts, including anions of carboxylic and/or hydroxycarboxylic acid or acids and/or an inorganic acid or acids, preferably anions of the same acid or acids as specified for part (A);

(D) a surfactant;

(E) a sufficient amount of hydrotrope material to produce a stable homogeneous solution or dispersion of components (A) through (C) in water; and (F) a sufficient amount of an antimicrobial material to inhibit growth of any bacteria and/or fungi that may be present in the composition.

Another embodiment of the invention is an aqueous concentrate that can be diluted with water only to produce, optionally after adjustment of pH by adding an acid or base, a composition as given above ready for use as such in cleaning plastic surfaces. The term "water only" herein is intended to include water from normal domestic and industrial water supplies as well as deionized, distilled, or other specially purified water. The aqueous concentrate is characterized by having a lesser amount of water than a working cleaning solution of the present invention.

A process according to this invention comprises contacting a soiled plastic surface with a suitable composition according to the invention as described above for a sufficient time at a sufficiently high temperature to achieve the desired amount of soil removal. Surfaces that can be effectively cleaned according to this invention include, but are not limited to, polyester sheet molding compound ("SMC"); polyvinyl chloride ("PVC") homopolymers and copolymers; polyurethane and polyurea plastics such as those made commercially by injection molding; terpolymers of acrylonitrile, butadiene, and styrene ("ABS"); poly{phenylene oxide} ("PPO") and copolymers of "phenylene oxide" with other materials such as polyamides; polycarbonate ("PCO") polymers and copolymers; and thermoplastic polyolefins ("TPO"). The invention is particularly suited to cleaning plastics, more particularly SMC, that contain solid filler materials, especially those that are chemically alkaline, such as calcium carbonate.

DETAILED DESCRIPTION OF THE PREFERRED EMBODIMENT(S)

Figure 1:
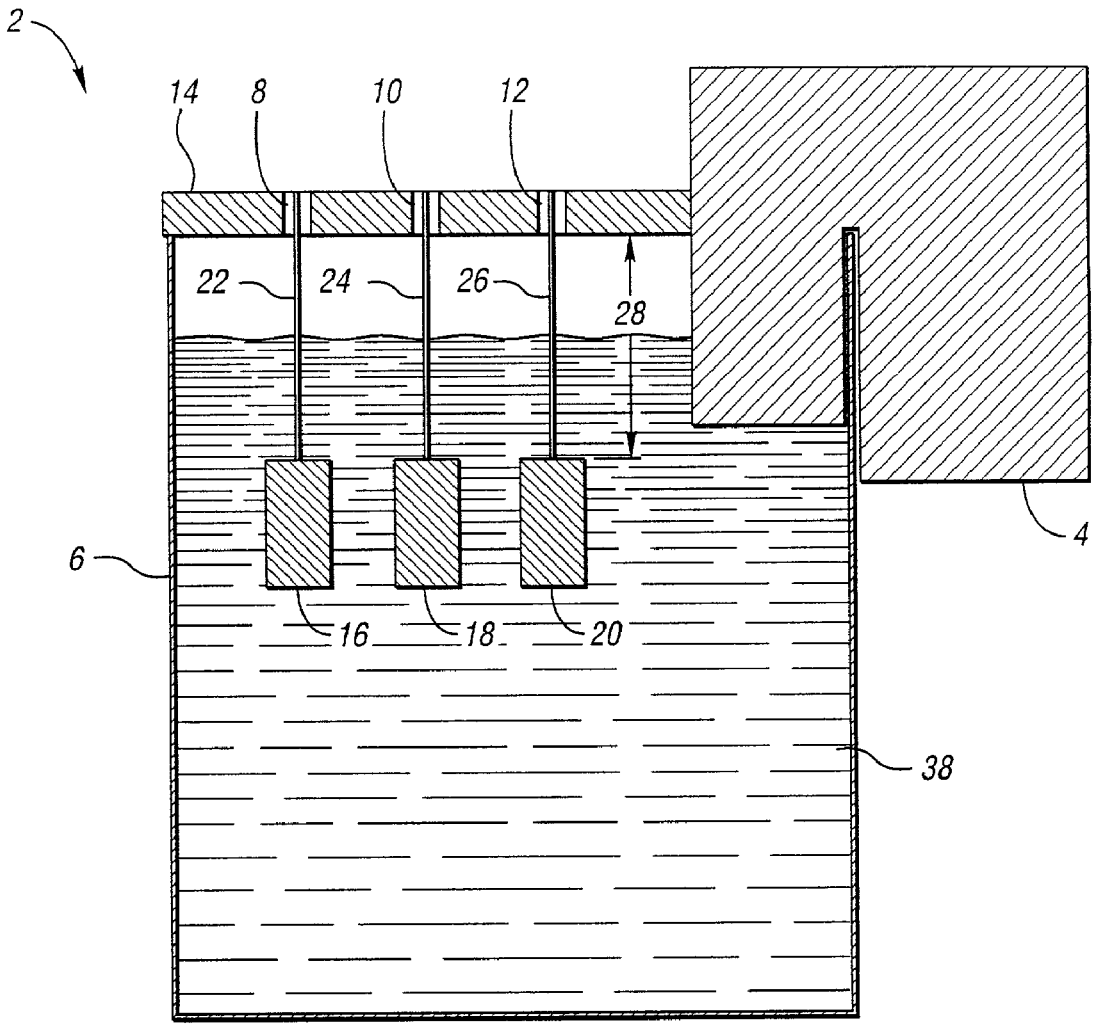
FIG. 1 is a schematic of the apparatus for quantifying the amount of etching of a metallic surface of the present invention is provided.

One embodiment of a composition according to this invention, specifically a composition suited for direct use as such in cleaning plastic surfaces, is an acidic aqueous liquid solution that has a pH in the range from 2.0–6.1, or more preferably in the range from 2.5–5.7; that has a buffering capacity sufficiently high that at least 0.06, or more preferably at least 0.23, milliequivalents of a strong alkali per liter of the composition must be added to raise the pH of the composition by 0.1 pH unit; and that comprises, or preferably consists essentially of, water and:

(A) from 1.0 to 30 milliequivalents per kilogram of the total composition ("mEq/kg"), preferably from 5 to 25 mEq/kg, or more preferably from 10 to 20 mEq/kg, of carboxylic acids and/or hydroxycarboxylic acids and/or inorganic acids; and (B) from an amount greater than 0.0 to an amount of 20 grams per kilogram of total composition (g/kg), preferably from 0.01 to 10 g/kg, or more preferably from 0.01 to 5 g/kg of an amphoteric surfactant, and even more preferably from 0.01 to 1.0, and most preferably from 0.01 to 0.1;

and optionally one or more of (C) and (D) below:

(C) from 0 to 60 mEq/kg, preferably from an amount greater than 0.0 to 60 Meq/kg, more preferably from 5 to 40 mEq/kg, or even more preferably from 10–30 mEq/kg, of salts including anions of carboxylic and/or hydroxycarboxylic acid or acids and/or inorganic acid or acids, preferably anions of the same acid or acids as specified for part (A);

(D) from 0.01 to 5 grams per kilogram of total composition ("g/kg"), preferably from 0.01 to 3 g/kg, more preferably from 0.01 to 2 g/kg, of a surfactant;

and, optionally but preferably (E) and (F) below, (E) a sufficient amount of hydrotrope material to produce a stable homogeneous solution or dispersion of components (A) through (D) in water; and (F) a sufficient amount of an antimicrobial material to inhibit growth of any bacteria and/or fungi that may be present in the composition.

In this description, an equivalent of acid is to be understood as the amount that would provide one gram atom of hydrogen atoms upon complete ionization, and an equivalent of the salt of such an acid is to be understood as the amount of the salt that requires the replacement of some other cations with one gram atom of hydrogen ions to regenerate the free acid.

Within the broadest scope of the invention, at least one acid selected from the group consisting of carboxylic acids, hydroxycarboxylic acids, and inorganic acids other than phosphoric acid may be used for ingredient (A) above. Preferably, any organic acid made up of molecules each of which contains at least one carboxyl group and at least one hydroxyl or additional carboxyl group may be used for ingredient (A) above. Thus, for example, gluconic acid, hydroxyacetic acid, lactic acid, succinic acid, fumaric acid, potassium acid phthalate, tartaric acid, malonic acid, and citric acid could all be used. More preferably, component (A) is made up of molecules with not more than six carbon atoms each and with at least three, or more preferably, at least four, total —OH and —COOH groups per molecule. The most preferred acid for ingredient (A) is citric acid.

Within the broadest scope of the invention, any conventional amphoteric surfactant that is water soluble or dispersible may be used for component (B). More preferred amphoteric surfactants are those containing positively charged amine (ammonium ion) functionality and negatively charged carboxylic acid (carboxylate ion) functionality at a neutral pH. Even more particularly preferred amphoteric surfactants include N-alkyl-aminocarboxylates and N-alkyl-iminocarboxylates. Such materials have the general structure:

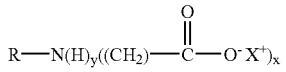

wherein the alkyl group R is a $C_{10}$–$C_{22}$ alkyl group (more preferably, a $C_{12}$–$C_{18}$ alkyl group such as $CH_3$—$(CH_2)_n$— (with n=9–21, more preferably 11–17), x=1 or 2, y=0 or 1, x+y=2, z=1–6 (preferably, 2) and X is an alkali metal (preferably, Na). Such surfactants have been found to provide enhanced reduction of metal etching when used in the compositions of the present invention as compared to other types of amphoteric surfactants. Most preferably, the amphoteric surfactant comprises Deriphat 160 (disodium N-lauryl-beta-iminodipropionate commercially available from Cognis Corporation, Cincinnati, Ohio). Other suitable, but less preferred, classes of amphoteric surfactants include imidazole amphoterics such as alkyl imidazoline dicarboxylates and amido-betaines such as cocoamidopropyl betaines. Examples of suitable, but less preferred, amphoteric surfactants include Amphoterge KJ-2 (20 parts per hundred capryloamphocarboxypropionate 20 parts per hundred Caproamphocarboxypropionate commercially available from Lonza); and Tego Betaine F, C, and E ("cocoamidopropyl betaine" commercially available from Goldschmidt Chemical Corporation, Hopewell, Va.)

The present invention optionally includes a surfactant, component (D). Any conventional surfactant that is water soluble or dispersible may be used for component (D). Preferably, the surfactant, component (D), is non-ionic. Preferred molecules for this component are generally those made by, or having a structure that could be made by, condensing fatty alcohols with suitable amounts of ethylene oxide, and optionally also with some propylene or other higher alkylene oxides, as generally known in the art.

The present invention also optionally includes a hydrotrope. A hydrotrope is defined generally as a substance that increases the solubility in water of another material that is only partially soluble. Within the context of this specification, a hydrotrope is a material that increases the solubility of component (D) as defined above in water, and more particularly in water containing substantial amounts of salts and ionizable acids as described in components (A) and (C) above. Hydrotrope component (E) is usually preferred in the composition because the relatively large amounts of salt present in the composition might otherwise tend to reduce the solubility of non-ionic detergents to a level where the ability of the composition to remove and disperse organic soils is less than desirable. The effect of the hydrotrope includes but is not limited to improving the heat stability of the concentrate composition described below. The presence of a hydrotrope, preferably an ammonium or alkali metal salt of a sulfonate of toluene, xylene, or cumene, makes possible the presence of relatively high amounts of both salt and nonionic surfactant in an aqueous solution. A concentration (g/kg) of hydrotrope equal to from one quarter to three quarters of the concentration of salt component (C) present is generally preferred. The most preferred hydrotrope is sodium cumene sulfonate.

It should be understood that the above description of a composition according to the invention is not intended to imply that there may not be chemical interactions among the components specified in the composition. The description refers to the components as added, or as reduced or increased in amount in situ by acid-base reactions, and does not exclude new chemical entities that may be formed by interaction in the composition.

Another embodiment of the invention comprises an aqueous concentrate that can be diluted with water only to produce, optionally after adjustment of pH by adding acid or base, a composition as given above ready for use as such in cleaning plastic surfaces. The term "water only" herein is intended to include water from normal domestic and industrial water supplies as well as deionized, distilled, or other specially purified water. It is normally preferred that a concentrate have a composition such that a solution of from 0.5 to 4% by weight of the concentrate in water will be suitable for direct use for cleaning plastics as described above.

The aqueous concentrate preferably has a pH in the range from 2.0–6.1, or more preferably in the range from 2.5–5.7; that has a buffering capacity sufficiently high that at least 0.06, or more preferably at least 0.23, milliequivalents of a strong alkali per liter of the composition must be added to raise the pH of the composition by 0.1 pH unit; and that comprises, or preferably consists essentially of, water and:

(A) from 100 to 3,000 milliequivalents per kilogram of the total composition ("mEq/kg"), preferably from 300 to 1,500 mEq/kg, or more preferably from 500 to 1,000 mEq/kg, of carboxylic acids and/or hydroxycarboxylic acids and/or inorganic acids; and (B) from an amount greater than 0.0 to an amount of 20 grams per kilogram of total composition (g/kg), preferably from 0.01 to 10 g/kg, or more preferably from 0.01 to 5 g/kg of an amphoteric surfactant; and optionally one or more (C) and (D) below:

(C) from 0 to 3,000 mEq/kg, preferably from 250 to 2,000 mEq/kg, or more preferably from 500–1,500 mEq/kg, of salts including anions of carboxylic and/or hydroxycarboxylic acid or acids and/or inorganic acid or acids, preferably anions of the same acid or acids as specified for part (A);

(D) from 0.1 to 100 grams per kilogram of total composition ("g/kg"), preferably from 0.1 to 50 g/kg, more preferably from 0.1 to 30 g/kg, of nonionic surfactant;

and, optionally but preferably (E) and (F) below, (E) a sufficient amount of hydrotrope material to produce a stable homogeneous solution or dispersion of components (A) through (D) in water; and (F) a sufficient amount of an antimicrobial material to inhibit growth of any bacteria and/or fungi that may be present in the composition.

A process according to this invention comprises contacting a soiled plastic surface with a suitable composition according to the invention as described above for a sufficient time at a sufficiently high temperature to achieve the desired amount of soil removal. Contacting between the surface and the liquid composition according to the invention may be accomplished by any convenient method, such as immersing the surface in a container of the liquid composition, spraying the composition on the surface, or the like, or by a mixture of methods. The liquid composition of the present invention is particularly suited for processes in which metal containers are employed to hold the liquid composition of the present invention. Any temperature between just above the freezing point and just below the boiling point of the liquid cleaning composition may generally be used, with a temperature of 40° C. to 70° C. generally preferred and 50° C.–60° C. more preferred.

At these preferred temperatures, a time of contact from 20–120 seconds is generally preferred for spraying applications, with from 45–90 seconds more preferred. For immersion applications, a time of contact from 40–240 seconds is generally preferred, with 90–180 seconds more preferred.

After cleaning as described immediately above, it is generally preferred to rinse the cleaned surface with water to remove any residue of the cleaning composition before subsequent use or surface finishing of the cleaned plastic. Most preferably, at least the last such rinse should be with deionized or other purified water. Usually, the rinsed surface should then be dried before subsequent finishing treatments. Drying also may be accomplished by any convenient method, such as a hot air oven, exposure to infra-red radiation, microwave heating, or the like.

As already noted above, one of the major objects of this invention is to avoid phosphate pollution. It is therefore increasingly more preferred that the compositions according to this invention contain no more than 2, 1, 0.5, 0.25, 0.1, or 0.01 percent by weight of phosphate or other phosphorus containing anions produced by the ionization of phosphoric or condensed phosphoric acids. Similarly, to avoid air and waste water pollution and fire hazards, it is increasingly more preferred that the compositions according to this invention contain no more than 2, 1, 0.5, 0.25, 0.1, or 0.01 percent by weight of organic solvents or other organic materials with a boiling point lower than that of water.

The major motive for providing a high buffer capacity in compositions according to the invention as described above is to provide substantial consistency of cleaning effect as the composition is used. This is particularly important when part of the cleaning involves removing alkaline types of soils, especially fatty acid soaps frequently used in the plastics industry as internal and external mold release agents, such as, zinc and calcium stearate; and also when the plastic being cleaned contains alkaline filler materials, such as the very commonly used calcium carbonate. In such cases, it eventually becomes advantageous to replenish the acid constituent of the composition as it is consumed during use.

In another embodiment of the present invention, etch-measuring apparatus 2 for quantifying the amount of etching of a metallic surface by a plastic cleaning solution is provided. Referring to FIG. 1, combination heating and pump unit 4 is in communication with a reservoir 6. A preferred combination heating and pump unit is a Haake DC1, while a preferred reservoir is a battery jar with a capacity of 8.25 gallons. Heating and pump unit 4 is able to be thermostatically set and is capable of holding an equilibrium temperature to within ±0.2° C. The circulation in this setup is vigorous, however, and the flow is characteristically different at various positions in the tank. Preferably, three or more arbitrarily positioned holes 8, 10, 12 are drilled into cover 14 from with test coupons 16, 18, 20 are suspended by wires 22, 24, 26. Wires 22, 24, 26 allow the test coupons 16, 18, 20 to be positioned at a predetermined depth 28 in cleaning solution 30. Test coupons 16, 18, 20 are assigned a letter or symbol designation so the location of the coupons in apparatus 2 can be tracked.

In another embodiment of the present invention, a method for measuring the amount of etching of metal surfaces is provided. Approximately 1 inch by 4 inch cold rolled steel (CRS) coupons are scuff sanded with an abrasive pad (Scotch-Brite) to clean and generate a fresh surface. The CRS prepared in this manner correspond to test coupons 16, 18, 20 in FIG. 1. After drying, the test coupons are weighed and the weight is used to produce a correction factor to normalize the weights. The correction factor is given by:

$$18.2814 \div \text{weight of a fresh coupon} = \text{correction factor}$$

The value 18.2814 represents the weight in grams of a coupon arbitrarily chosen as a standard against which all measurements are normalized. Furthermore, the correction factor takes into account the fact that larger samples will have a greater surface area. Etch-measuring apparatus 2 is filled with cleaning solution 30. Test coupons 16, 18, 20 are suspended in cleaning solution 30 by wires 22, 24, 26. After a predetermined time test coupons 16, 18, 20 are removed from etch measuring unit 2 and dried and re-weighed. The difference between the weight of a fresh coupon and a coupon exposed to the cleaning solution is the weight loss. The amount of etching of the CRS coupons expressed as mils per year is given by the following formula:

$$\text{weight loss(g)} \times \text{correction factor} \times 7635 = \text{mils per year}$$

The practice of this invention may be further appreciated from the following, non-limiting, working examples.

EXAMPLE 1

For this example, a plastic cleaning composition was prepared by combining together the following:

| | |
|---|---|
| citric acid | 47.5 PBW (parts by weight) |
| sodium meta-bisulfite | 0.8 PBW |
| Naxonate SC | 18.0 PBW |
| Triton DF 16 | 57.0 PBW |
| water | 876.7 PBW |

Naxonate SC (sodium cumene sulfonate commercially available from Ruetgers-Neace Chemical Co., State College, Pa.) is a hydrotrope, and Triton DF-16 (commercially available from Rohm & Haas Co., Philadelphia) is an non-ionic surfactant. As set forth below, varying amounts of the surfactant Deriphat 160 is added to the plastic cleaning solution to form a low etch solution.

The amount of etching of CRS coupons for the low etch solution of this example is measured according to the method described above. A summary of the raw data is provided in Table 1. Three CRS coupons are scuff sanded with an abrasive pad, dried, and weighed. The CRS coupons are then attached to a suspension wire and suspended in the Deriphat 160 containing solution. After 60 minutes the coupons are removed from etch measuring unit, dried and re-weighed. The measurements are conducted for 32,764 grams of a 2% solution of the cleaning composition described in the preceding paragraph having the amphoteric surfactant, Deriphat 160, in amounts of 0.00 grams, 0.94 grams, 1.87 grams, 2.81 grams, and 5.61 grams. Referring to Table 1, the column "Flow Point" corresponds to differing positions in the etching measuring apparatus, the column "Chip" corresponds to the three CRS coupons which are measured, the column "Deriphat 160" gives the amount of Deriphat 160 in grams, the column "Initial weight" gives the initial weight of the CRS coupon, the column "Final weight" gives the final weight of the CRS coupons, the column "Loss" gives the difference between the initial and final weights of the coupon, the column "correction factor" is the correction factor defined above, the column "mils per year" gives the amount of material etched by the cleaning solution, and the column "initial pH" is the pH of the solution as added without surfactant. The column "100 ml points" provides information about the buffering capacity of the cleaning composition. Specifically, "100 ml points" are the number of milliliters of a 0.1 N sodium hydroxide solution needed to increase the pH of a 100 ml aliquot of the working solutions to a value of approximately 8.

TABLE 1

| Flow point | Chip | Deriphat 160 | ° C. | Initial Wt. | Final Wt. | Loss | Correction factor | Mils per year | 100 ml Pts | Initial pH |
|---|---|---|---|---|---|---|---|---|---|---|
| A | X | 0.00 | 55 | 17.4854 | 17.4308 | 0.0546 | 1.044 | 435 | 16.9 | 2.77 |
| B | & | 0.00 | 55 | 16.0977 | 16.0519 | 0.0458 | 0.99 | 349 | 16.9 | 2.77 |
| C | H | 0.00 | 55 | 17.0877 | 17.0413 | 0.0464 | 1.007 | 357 | 16.9 | 2.77 |
| A | M | 0.94 | 55 | 16.6703 | 16.6565 | 0.0138 | 0.979 | 103 | — | — |
| B | T | 0.94 | 55 | 17.7818 | 17.7696 | 0.0122 | 1.003 | 93.4 | — | — |
| C | N | 0.94 | 55 | 17.7634 | 17.7516 | 0.0188 | 0.939 | 84.6 | — | — |
| A | K | 1.87 | 55 | 19.0926 | 19.0789 | 0.0137 | 0.941 | 98.4 | — | — |
| B | E | 1.87 | 55 | 17.9940 | 17.9823 | 0.0117 | 0.994 | 88.8 | — | — |
| C | P | 1.87 | 55 | 17.2889 | 17.2782 | 0.0107 | 1.035 | 84.6 | — | — |
| A | D | 2.81 | 55 | 17.1710 | 17.1579 | 0.0131 | 0.994 | 99.4 | — | — |
| B | X | 2.81 | 55 | 17.4103 | 17.3984 | 0.0119 | 1.044 | 94.9 | — | — |
| C | & | 2.81 | 55 | 16.0388 | 16.0258 | 0.0130 | 0.999 | 99.2 | — | — |

TABLE 1-continued

| Flow point | Chip | Deriphat 160 | ° C. | Initial Wt. | Final Wt. | Loss | Correction factor | Mils per year | 100 ml Pts | Initial pH |
|---|---|---|---|---|---|---|---|---|---|---|
| A | P | 5.62 | 55 | 17.2649 | 17.2531 | 0.0118 | 1.035 | 93.2 | — | — |
| B | K | 5.62 | 55 | 19.0667 | 19.0549 | 0.0118 | 0.941 | 84.8 | — | — |
| C | E | 5.62 | 55 | 17.9693 | 17.9577 | 0.0116 | 0.994 | 88.0 | — | — |

As summarized in Table 1, the pH for the initial measurements of a cleaning composition which does not have any amphoteric surfactant is measured and found to be approximately 2.77. The initial 100 ml points of 16.9 determines that approximately 0.323 mEq of sodium hydroxide are needed to raise the pH of a liter of the cleaning solution by 0.1.

The average metal etch rates for this example are provided in Table 2.

TABLE 2

| Deriphat Level | Average Etch Rate (mils per year) | % etch reduction from zero level |
|---|---|---|
| 0.00 | 380 | 0.0 |
| 0.94 | 94 | 75.3 |
| 1.87 | 91 | 76.1 |
| 2.81 | 98 | 74.2 |
| 5.62 | 89 | 76.6 |

Table 2 clearly demonstrates that addition of Deriphat 160 to a cleaning solution having citric acid results in a dramatic 75% reduction in metal etching.

EXAMPLE 2

For this example, a plastic cleaning composition was prepared by combining together the following:

| | |
|---|---|
| citric acid | 47.5 PBW (parts by weight) |
| sodium meta-bisulfite | 0.8 PBW |
| Naxonate SC | 18.0 PBW |
| Triton DF 16 | 57.0 PBW |
| water | 876.7 PBW |

Naxonate SC (sodium cumene sulfonate commercially available from Ruetgers-Neace Chemical Co., State College, Pa.) is a hydrotrope, and Triton DF-16 (commercially available from Rohm & Haas Co., Philadelphia) is an non-ionic surfactant. As set forth below, varying amounts of the surfactant Amphoterge KJ-2 is added to the plastic cleaning solution to form a low etch solution.

The amount of etching of CRS coupons for the low etch solution of this example is measured according to the method described above. A summary of the raw data is provided in Table 3. Three CRS coupons are scuff sanded with an abrasive pad, dried, and weighed. The CRS coupons are then attached to a suspension wire and suspended in the Amphoterge KJ-2 containing solution. After 60 minutes the coupons are removed from etch measuring unit, dried and re-weighed. The measurements are conducted for 32,764 grams of a 2% solution of the cleaning composition described in the preceding paragraph having the amphoteric surfactant, Amphoterge KJ-2 amounts of 0.00 grams, 2.35 grams, 14.1 grams. These amounts correspond to 0.00 grams, 0.94 grams, and 5.62 grams of active component because Amphoterge KJ-2 is approximately 40% active. The columns in Table 3 have the same meaning as those in Table 1 except that now the column "Amphoterge KJ-2" corresponds to the weight in grams of Amphoterge KJ-2.

TABLE 3

| Flow point | Chip | Amphoterge KJ-2 (grams) | ° C. | Initial Wt. | Final Wt. | Loss | Correction factor | Mils per year | 100 ml Pts | Initial pH |
|---|---|---|---|---|---|---|---|---|---|---|
| A | D | 0.00 | 55 | 17.1479 | 17.0943 | 0.0536 | 0.994 | 407 | 16.6 | 2.69 |
| B | T | 0.00 | 55 | 17.7622 | 17.7150 | 0.0472 | 1.003 | 361 | 16.6 | 2.69 |
| C | N | 0.00 | 55 | 17.7398 | 17.6895 | 0.0503 | 0.939 | 361 | 16.6 | 2.69 |
| A | M | 2.35 | 55 | 16.5494 | 16.5102 | 0.0392 | 0.979 | 293 | — | — |
| B | & | 2.35 | 55 | 15.9256 | 15.8873 | 0.0383 | 0.999 | 292 | — | — |
| C | X | 2.35 | 55 | 17.3119 | 17.2755 | 0.0364 | 1.044 | 290 | — | — |
| A | N | 14.1 | 55 | 17.6741 | 17.6429 | 0.0312 | 0.939 | 224 | — | — |
| B | D | 14.1 | 55 | 17.0787 | 17.0504 | 0.0283 | 0.994 | 215 | — | — |
| C | T | 14.1 | 55 | 17.7008 | 17.6728 | 0.0280 | 1.003 | 214 | — | — |

As summarized in Table 3, the pH for the initial measurements of a cleaning composition which does not have any amphoteric surfactant is measured and found to be approximately 2.69. The initial 100 ml points of 16.6 approximately determines that 0.313 mEq of sodium hydroxide are needed to raise the pH of a liter of the cleaning solution by 0.1.

The average metal etch rates are provided in Table 4. Table 4 demonstrates that the addition of the amphoteric surfactant Amphoterge KJ-2 results in a significant reduction of etching of the CRS coupons, achieving a 42% reduction when 5.62 g are added to 32,754 g of the cleaning composition (0.18 g per liter of cleaning composition).

TABLE 4

| Amphoterge KJ-2 (grams active component) | Average Etch Rate (mils per year) | % etch reduction from zero level |
|---|---|---|
| 0.00 | 376 | 0.0 |
| 0.94 | 292 | 22.3 |
| 5.62 | 218 | 42.0 |

EXAMPLE 3

For this example, a plastic cleaning composition was prepared by combining together the following:

| | |
|---|---|
| citric acid | 47.5 PBW (parts by weight) |
| sodium meta-bisulfite | 0.8 PBW |
| Naxonate SC | 18.0 PBW |
| Triton DF 16 | 57.0 PBW |
| water | 876.7 PBW |

Naxonate SC (sodium cumene sulfonate commercially available from Ruetgers-Neace Chemical Co., State College, Pa.) is a hydrotrope, and Triton DF-16 (commercially available from Rohm & Haas Co., Philadelphia) is an non-ionic surfactant. As set forth below, varying amounts of the surfactant Tego Betaine F is added to the plastic cleaning solution to form a low etch solution.

The amount of etching of CRS coupons for the low etch solution of this example is measured according to the method described above. A summary of the raw data is provided in Table 5. Three CRS coupons are scuff sanded with an abrasive pad, dried, and weighed. The CRS coupons are then attached to a suspension wire and suspended in the Tego Betaine F containing solution. After 60 minutes the coupons are removed from etch measuring unit, dried and re-weighed. The measurements are conducted for 32,764 grams of a 2% solution of the cleaning composition described in the preceding paragraph having the amphoteric surfactant, Tego Betaine F amounts of 0.00 grams, 3.13 grams, 9.37 grams, and 18.73 grams. These amounts correspond respectively to 0.00 grams, 0.94 grams, 2.81 grams, and 5.62 grams of active component because Tego Betaine F is approximately 30% active The columns in Table 5 have the same meaning as those in Table 1 except that now the column "Tego Betaine F" corresponds to the weight in grams of Tego Betaine F.

As summarized in Table 5, the pH for the initial measurements of a cleaning composition which does not have any amphoteric surfactant is measured and found to be approximately 2.80. The initial 100 ml points of 16.6 approximately determines that 0.292 mEq of sodium hydroxide are needed to raise the pH of a liter of the cleaning solution by 0.1.

The average metal etch rates are provided in Table 6. Table 6 demonstrates that the addition of the amphoteric surfactant Tego Betaine F results in a significant reduction of etching of the CRS coupons, achieving about 40% reduction when 5.62 g are added to 32,754 g of the cleaning composition (0.18 g per liter of cleaning composition).

TABLE 6

| Tego Betaine F (grams active component) | Average Etch Rate (mils per year) | % etch reduction from zero level |
|---|---|---|
| 0.00 | 352 | 0.0 |
| 0.94 | 226 | 35.8 |
| 2.81 | 204 | 42.0 |
| 5.62 | 212 | 39.8 |

EXAMPLE 4

For this example, a lactic acid-containing cleaning solution is prepared by mixing the following components:

| | |
|---|---|
| Water | 862 PBW |
| Purac FCC 88 | 92.2 PBW |
| Naxonate SC | 23.0 PBW |
| Sodium meta-bisulfite | 0.8 PBW |
| Triton DF-16 | 22.0 PBW |

Purac FCC 88 is a 88% lactic acid in water and is manufactured by Purac America. Naxonate SC (sodium cumene sulfonate commercially available from Ruetgers-Neace Chemical Co., State College, Pa.) is a hydrotrope, and Triton DF-16 (commercially available from Rohm & Haas Co., Philadelphia) is an non-ionic surfactant. The amphoteric surfactant, Deriphat 160 is added to this lactic acid cleaning solution in varying amounts described below.

The amount of etching of CRS coupons for the low etch solution of this example is measured according to the method described above. A summary of the raw data is provided in Table 7. Three CRS coupons are scuff sanded

TABLE 5

| Flow point | Chip | Tego Betaine F (grams) | ° C. | Initial Wt. | Final Wt. | Loss | Correction factor | Mils per year | 100 ml Pts | Initial pH |
|---|---|---|---|---|---|---|---|---|---|---|
| A | K | 0.00 | 55 | 19.0512 | 19.0014 | 0.0498 | 0.941 | 358 | 15.2 | 2.80 |
| B | E | 0.00 | 55 | 17.9491 | 17.9036 | 0.0455 | 0.994 | 345 | 15.2 | 2.80 |
| C | P | 0.00 | 55 | 17.2449 | 17.2004 | 0.0445 | 1.035 | 352 | 15.2 | 2.80 |
| A | M | 3.13 | 55 | 16.5041 | 16.4700 | 0.0341 | 0.979 | 255 | — | — |
| B | X | 3.13 | 55 | 17.2661 | 17.2396 | 0.0265 | 1.044 | 211 | — | — |
| C | & | 3.13 | 55 | 15.8728 | 15.8451 | 0.0277 | 0.999 | 211 | — | — |
| A | P | 9.37 | 55 | 17.1906 | 17.1646 | 0.0260 | 1.035 | 205 | — | — |
| B | K | 9.37 | 55 | 18.9823 | 18.9542 | 0.0281 | 0.941 | 202 | — | — |
| C | E | 9.37 | 55 | 17.8905 | 17.8636 | 0.0269 | 0.994 | 204 | — | — |
| A | & | 18.73 | 55 | 15.8301 | 15.8019 | 0.0282 | 0.999 | 215 | — | — |
| B | M | 18.73 | 55 | 16.4510 | 16.4232 | 0.0278 | 0.979 | 208 | — | — |
| C | X | 18.73 | 55 | 17.2291 | 17.2025 | 0.0266 | 1.044 | 212 | — | — |

with an abrasive pad, dried, and weighed. The CRS coupons are then attached to a suspension wire and suspended in the Deriphat 160 containing solution. After 60 minutes the coupons are removed from etch measuring unit, dried and re-weighed. The measurements are conducted for 32,764 grams of a 2% solution of the lactic acid-containing cleaning solution described in the preceding paragraph having the amphoteric surfactant, Deriphat 160 amounts of 0.00 grams, 0.94 grams, 1.87 grams, 2.81 grams, and 3.74 grams. The columns in Table 7 have the same meaning as those in Table 1.

TABLE 7

| Flow point | Chip | Deriphat 160 (grams) | ° C. | Initial Wt. | Final Wt. | Loss | Correction factor | Mils per year | 100 ml Pts | Initial pH |
|---|---|---|---|---|---|---|---|---|---|---|
| A | N | 0.00 | 55 | 17.5305 | 17.4895 | 0.0410 | 0.939 | 294 | 14.2 | 2.64 |
| B | & | 0.00 | 55 | 15.7095 | 15.6733 | 0.0362 | 0.999 | 276 | 14.2 | 2.64 |
| C | M | 0.00 | 55 | 16.3223 | 16.2869 | 0.0354 | 0.979 | 265 | 14.2 | 2.64 |
| A | P | 0.94 | 55 | 16.9618 | 16.9491 | 0.0127 | 1.035 | 100 | — | — |
| B | X | 0.94 | 55 | 17.1173 | 17.1058 | 0.0115 | 1.044 | 91.7 | — | — |
| C | K | 0.94 | 55 | 18.7212 | 18.7090 | 0.0122 | 0.941 | 87.7 | — | — |
| A | D | 1.87 | 55 | 16.9425 | 16.9322 | 0.0103 | 0.994 | 78.2 | — | — |
| B | E | 1.87 | 55 | 17.6394 | 17.6289 | 0.0105 | 0.994 | 79.7 | — | — |
| C | T | 1.87 | 55 | 17.5766 | 17.5664 | 0.0102 | 1.003 | 78.1 | — | — |
| A | M | 2.81 | 55 | 16.2684 | 16.2569 | 0.0115 | 0.979 | 86.0 | — | — |
| B | N | 2.81 | 55 | 17.4750 | 17.4641 | 0.0109 | 0.939 | 78.1 | — | — |
| C | & | 2.81 | 55 | 15.6557 | 15.6457 | 0.0100 | 0.999 | 76.3 | — | — |
| A | K | 3.74 | 55 | 18.6946 | 16.6851 | 0.0095 | 0.941 | 68.3 | — | — |
| B | P | 3.74 | 55 | 16.9378 | 16.9288 | 0.0090 | 1.035 | 71.1 | — | — |
| C | X | 3.74 | 55 | 17.0941 | 17.0856 | 0.0085 | 1.044 | 67.8 | — | — |

As summarized in Table 7, the pH for the initial measurements of a lactic acid-containing cleaning solution which does not have any amphoteric surfactant is measured and found to be approximately 2.64. The initial 100 ml points of 14.2 approximately determines that 0.265 mEq of sodium hydroxide are needed to raise the pH of a liter of the cleaning solution by 0.1.

The average metal etch rates are provided in Table 8. Table 8 demonstrates that the addition of the amphoteric surfactant Deriphat results in a significant reduction of etching of the CRS coupons, achieving a 75% reduction when 3.74 g are added to 32,754 g of the lactic acid solution of this example.

TABLE 8

| Deriphat (grams) | Average Etch Rate (mils per year) | % etch reduction from zero level |
|---|---|---|
| 0.00 | 278 | 0.0 |
| 0.94 | 93 | 66.5 |
| 1.87 | 79 | 71.6 |
| 2.81 | 80 | 71.2 |
| 3.74 | 69 | 75.2 |

Experimental observations have confirmed that the following concentrate composition has become preferred:

| Ingredient | Nominal W/% |
|---|---|
| Water | 86.3 |
| Citric Acid | 6.0 |
| 45% KOH | 3.5 |

-continued

| Ingredient | Nominal W/% |
|---|---|
| Naxonate SC | 1.6 |
| Sodium Bisulfite | 0.08 |
| Triton DF-16 | 2.2 |
| Deriphat 160 | 0.35 |

| Property | Observation |
|---|---|
| Cloud Point | 120° F. |
| Package pH | 3.65 |
| Etch Rate @ 2% | 75 |
| Cold Stability | Good |
| Freeze Stability | Good |

It will be appreciated that the composition described above is a nominal composition, with each component having a weight which is ±5 weight percent.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An aqueous liquid composition comprising:

water;

at least one acid selected from the group consisting of carboxylic acids, hydroxycarboxylic acids and inorganic acids other than phosphoric acid wherein the at least one acid is present in an amount from about 100 to about 3,000 milliequivalents per kilogram of total composition ("mEq/kg");

an amphoteric surfactant wherein the amphoteric surfactant is present in an amount from about 0.01 to about 20 grams per kilogram of total composition ("g/kg"), the aqueous liquid composition having a pH from about 2.0 to about 6.1;

a non-ionic surfactant present in the composition in a weight percent from 5 to 50 g/kg, based on the total weight of the composition; and a hydrotrope in an amount sufficient to produce a stable homogeneous solution or dispersion of the at least one acid, the amphoteric surfactant and the non-ionic surfactant in water, the composition being substantially or entirely free from volatile organic solvents, wherein the water is present in the composition in a weight percent of about 83–89%, based on the total weight % of the composition, wherein the composition further comprises:

a 45% solution of potassium hydroxide present in the composition in a weight percent about 2.5–4.6%, based on the total weight of the composition;

sodium bisulfite present in the composition in a weight percent about 0.08%, based on the total weight of the composition; and the hydrotrope includes sodium cumene sulfonate present in the composition in a weight percent about 1.1–2.1%, based on the total weight of the composition.

2. An aqueous liquid composition comprising a 0.5 to 4% by weight solution of the aqueous liquid composition of claim 1.

3. An aqueous liquid composition comprising:

water;

at least one acid selected from the group consisting of carboxylic acids, hydroxycarboxylic acids, and inorganic acids other than phosphoric acid wherein the at least one acid is present in an amount from about 1.0 to about 30 milliequivalents per kilogram of total composition ("mEq/kg");

an amphoteric surfactant wherein the amphoteric surfactant is present in an amount from about 0.002 to about 0.015 grams per kilogram of total composition ("g/kg");

a non-ionic surfactant present in the composition in a weight percent of about 0.03–0.058% based on the total weight of the composition;

a hydrotrope present in the composition in a weight percent about 0.022–0.042%, based on the total weight of the composition; and the aqueous liquid composition having a pH from about 2.0 to about 6.1 and having a reduced etch attack on metal as compared to an aqueous composition comprising from about 1.0 to about 30 milliequivalents per kilogram of total composition ("mEq/kg") of acids selected from the group consisting of carboxylic, hydroxycarboxylic, and inorganic acids, and not containing the amphoteric surfactant.

4. The aqueous liquid composition of claim 3, wherein the amphoteric surfactant is present in an amount from about 0.002 to 0.010 grams per kilogram of total composition.

5. The aqueous liquid composition of claim 3, wherein the at least one acid comprises at least one carboxylic acid.

6. The aqueous liquid composition of claim 5, wherein the at least one acid is made up of molecules with not more than six carbon atoms with at least three total —OH and —COOH groups per molecule.

7. The aqueous liquid composition of claim 3, wherein the amphoteric surfactant contains positively charged amine functionality and negatively charged carboxylic acid functionality at a neutral pH.

8. The aqueous liquid composition of claim 3, further comprising 3.9–7.3 milliequivalents per kilogram of salts, the salts being selected from the group consisting of anions of carboxylic acid, anions of hydrocarboxylic acid.

9. An aqueous liquid composition consisting essentially of:

water;

at least one acid selected from the group consisting of carboxylic acids, hydroxycarboxylic acids, and inorganic acids other than phosphoric acid wherein the at least one acid is present in an amount of 600–1100 milliequivalents per kilogram of total composition ("mEq/kg");

an amphoteric surfactant wherein the amphoteric surfactant is present in an amount of 2.5–4.6 grams per kilogram of total composition ("g/kg"), the aqueous liquid composition having a pH from about 2.0 to about 6.1;

a non-ionic surfactant present in the composition in a weight percent of 5 to 50 grams per kilogram, based on the total weight of the composition; and sodium cumene sulfonate present in the composition in a weight percent about 11–21 grams per kilogram, based on the total weight of the composition.

10. The aqueous liquid composition of claim 3 wherein the composition further comprises a 45% solution of potassium hydroxide present in the composition in a weight percent of about 0.05–0.092%, based on the total weight of the composition.

11. A method of cleaning plastic members comprising:

exposing a plastic member to an aqueous liquid composition according to claim 1.

12. A method of cleaning plastic members comprising:

exposing a plastic member to an aqueous liquid composition according to claim 3.

13. A method of cleaning plastic members comprising: exposing a plastic member to an aqueous liquid composition according to claim 9.

* * * * *